United States Patent [19]

Roamer

[11] 4,022,344

[45] May 10, 1977

[54] ATTACHMENT FOR A LIQUID CONTAINER

[76] Inventor: Louis S. Roamer, 1219 Alton St., Wilmington, Calif. 90744

[22] Filed: Nov. 10, 1975

[21] Appl. No.: 630,738

[52] U.S. Cl. ..... 220/4 A; 220/85 SP; 220/90

[51] Int. Cl.[2] ..... B65D 7/00; B65D 25/00

[58] Field of Search ..... 220/4 A, 85 SP, 90; 222/569, 570

[56] References Cited

UNITED STATES PATENTS

| | | | |
|---|---|---|---|
| 2,786,614 | 3/1957 | Giusto | 220/90 X |
| 2,842,286 | 7/1958 | Beyer | 220/90 |
| 3,239,113 | 3/1966 | Knize | 220/90 X |
| 3,298,561 | 1/1967 | McConnie | 220/90 |
| 3,543,287 | 11/1970 | Henkel | 220/90 |

*Primary Examiner*—George E. Lowrance
*Assistant Examiner*—Steven M. Pollard
*Attorney, Agent, or Firm*—Jack C. Munro

[57] ABSTRACT

The attachment of this invention is to be employed in combination with a container, such as a gallon shaped paint can. The attachment takes the form of a circular cylinder being open at each end. The lower portion of the cylinder is to tightly connect with the liquid container. The upper edge of the cylinder is to be connectable with a lid. A spout is attached to the side wall of the cylinder. Located interiorly of the cylinder adjacent the lower end thereof is an inwardly extending annular flange to cause any liquid contained within the cylinder to drain back into the container without contaminating the upper edge of the liquid container.

2 Claims, 6 Drawing Figures

ATTACHMENT FOR A LIQUID CONTAINER

BACKGROUND OF THE INVENTION

In handling paints and other protective liquids, as well as innumerable other materials, it is difficult to properly stir, mix and pour these liquids without causing spillage over the sides of the container onto surrounding surfaces. Moreover, pouring a controlled volume of liquid at a controlled rate is extremely difficult. Within paint containers, the container is filled to the top with the paint at the time of purchase. To stir the paint within this container will normally result in the paint spilling over the sides of the container. To overcome this problem, it would be desirable to be able to add an additional volume to the paint container so as to prevent spillage during stirring. Further, with a conventional paint container, it is very difficult to pour the paint at a controlled rate from a full paint container. However, by the adding of an additional volume and the including of a pouring spout, the paint can be poured at a controlled rate.

Paint containers also include an annular lip at its upper edge which is to facilitate connecting with a closing lid. When a person dips a paint brush into the paint container and then wipes the brush on the side wall of the lip, some of the paint will naturally be caused to run into the lip. The result is that this lip fills with paint and it is very difficult to remove and upon the closing of the lid, the paint within the lip will be caused to splatter about the paint can. This is a most undesirable feature.

SUMMARY OF THE INVENTION

The subject matter of this invention is believed to be summarily described in the Abstract Of The Disclosure and reference is to be had thereto.

The primary objective of the subject matter of this invention is to provide an attachment to an open liquid container to provide an enlarged volume to facilitate stirring and/or mixing of the liquid contained within the container. A further objective of this invention is that it includes means for enclosing the upper end of the attachment to provide a seal equivalent to that of the original container. A further objective is to provide a closable spout protruding from the side wall of the attachment to enable the liquid to be readily poured at a controlled rate from the combined original container and its extender device without incurring any spillage. The attachment of this invention can be varied in size to fit all standard container sizes and shapes, including those having cross-sections other than circular. The overall elongated dimension of the attachment is to be sufficient to permit vigorous stirring of a full can of liquid without causing spillage. In its preferred form of manufacture, the attachment of this invention is to be molded of an integral piece of plastic. However, the attachment could be formed of metal, if desired.

DETAILED DESCRIPTION OF THE SHOWN EMBODIMENT

Figure 1:
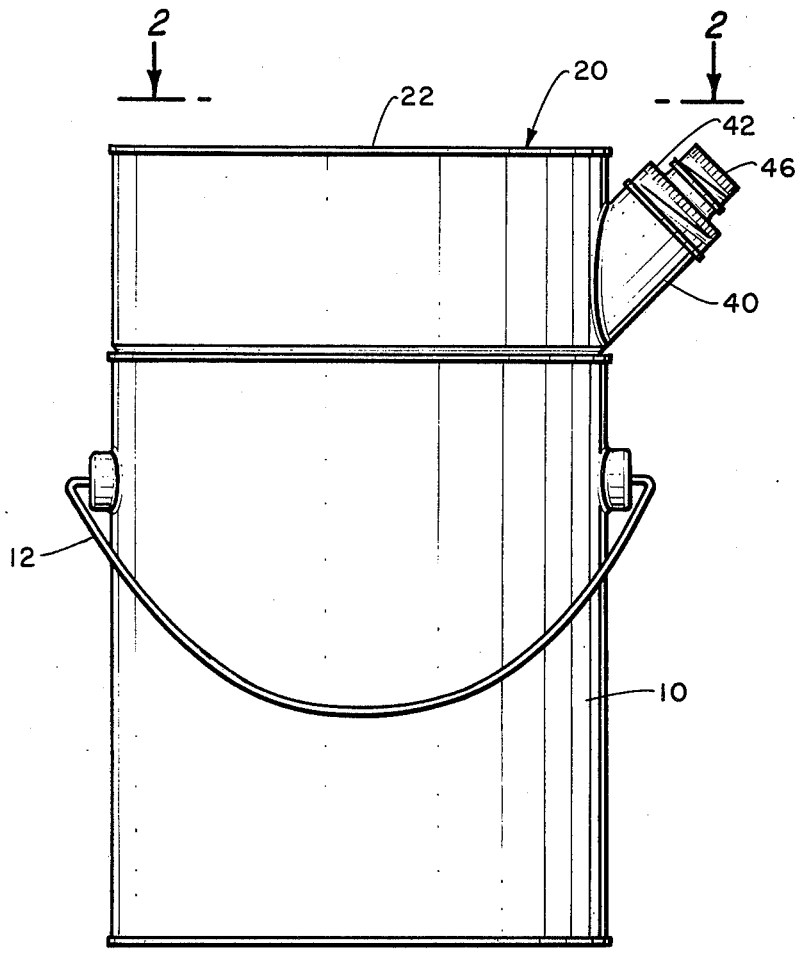
FIG. 1 is a side view of the attachment of this invention showing how such is mounted with a conventional liquid container.
Figure 2:
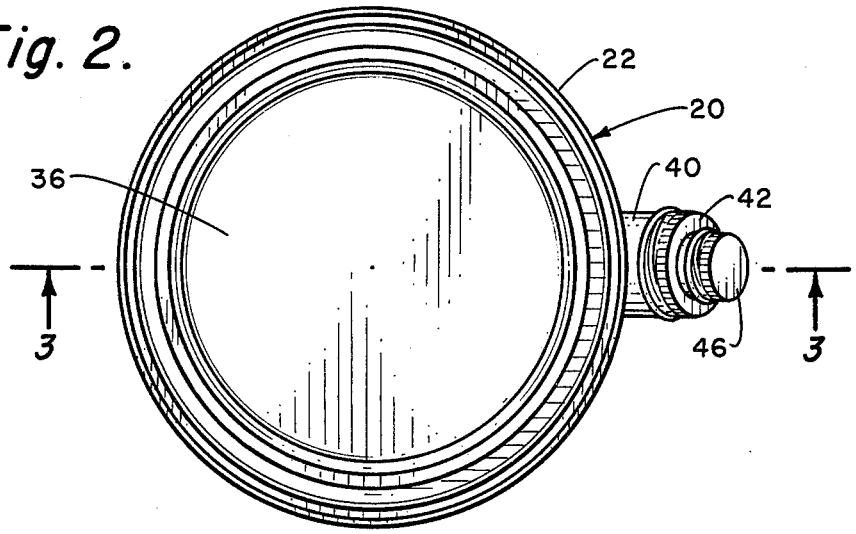
FIG. 2 is a top view taken along line 2—2 of FIG. 1.

Referring particularly to the drawings, there is shown a conventional basically cylindrical shaped in cross-section liquid container 10 which is frequently referred to as a one gallon size paint pail. The paint pail 10 includes a bail 12 attached thereto. The liquid container 10 includes an interior liquid containing chamber 14 with access being provided therethrough through access opening 16. Surrounding the access opening 16 is a conventional annular shaped anchoring rim 18 which is formed into the shape of an annular recess.

To be connected with the container 10 is the attachment 20 of this invention. The attachment 20 includes a cylindrical shaped housing 22 which includes therein an interior chamber 24. Access into the interior chamber 24 is provided by an outer opening 26 and an inner opening 28.

Figure 3:
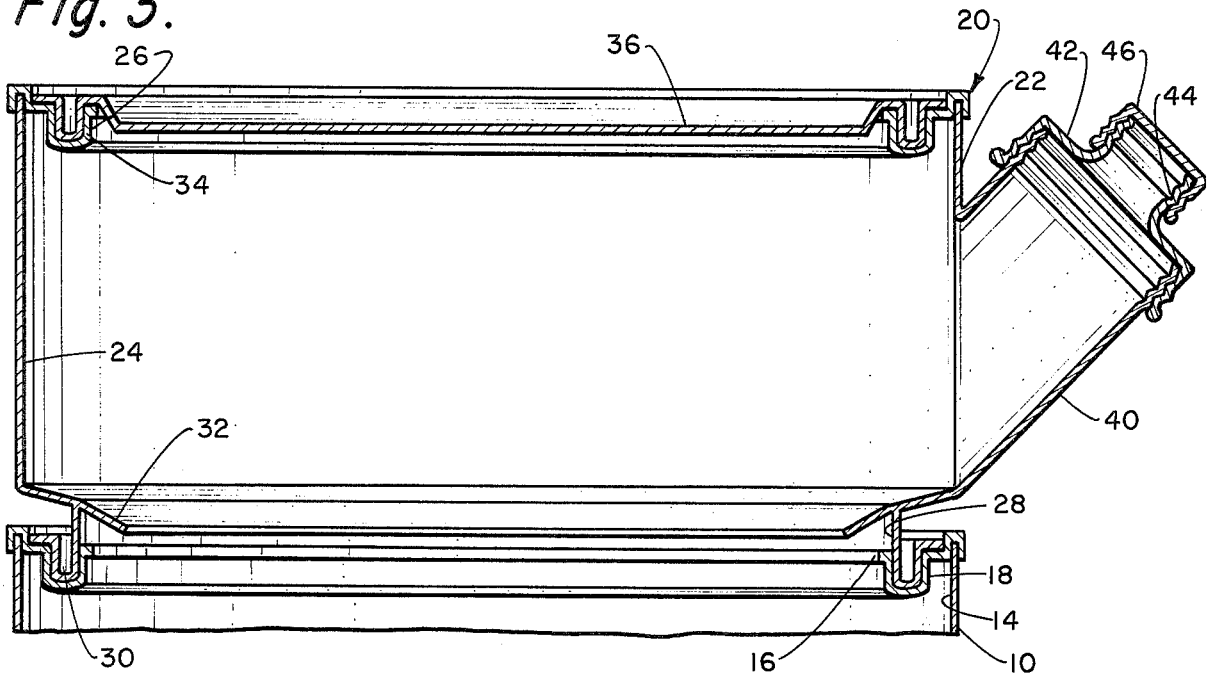
FIG. 3 is a cross-sectional view taken along line 3—3 of FIG. 2.

Adjacent the inner opening 28 is an annularly shaped lip 30. The lip 30 is to matingly fit in a tight fitting manner within the anchoring rim 18 as shown in FIG. 3 of the drawings. This securely mounts the attachment 20 to the container 10.

Located adjacent the inner opening 28 and positioned within the chamber 24 is an annular depending flange 32. The flange 32 is slanted in the downward direction. The function of the flange 32 is that any liquid contained within the chamber 24 that may be running down the interior side wall of the housing 22 is caused to drip off the flange 32 into the chamber 14. This prevents the liquid from coming into contact with the annular lip 30 and be conducted between the lip 30 and the anchoring rim 18. Thereby, the anchoring rim 18 is maintained clean and completely free of any of the liquid contained within the container 10.

Adjacent the outer opening 26 is located an annular anchoring rim 34 which is similar in construction to the rim 18. In actual practice, the container 10 will normally be transmitted to the consumer with a lid 36 secured in conjunction with the anchoring rim 18. Upon mounting of the attachment 20 upon the container 10, the lid 36 may be placed in conjunction with the anchoring rim 34, as shown in FIG. 3 of the drawings.

Figure 4:
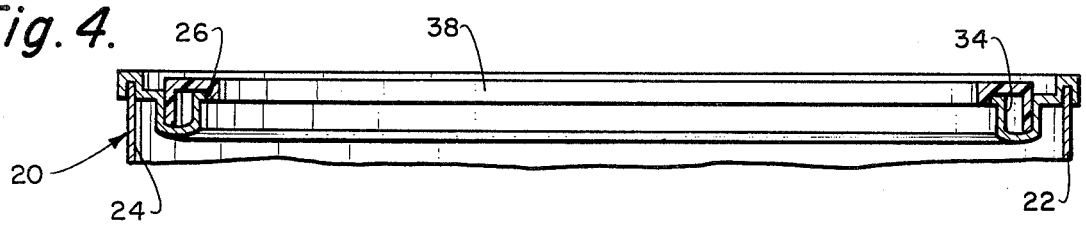
FIG. 4 is an enlarged cross-sectional view of the upper end of the attachment showing the use of an additional plastic rim within the lid anchoring rim portion of the device.
Figure 5:
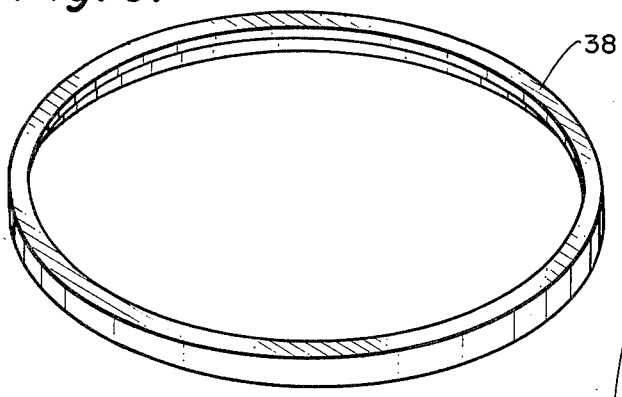
FIG. 5 is an isometric view of the separate plastic ring shown in cross-section in FIG. 4.
Figure 6:
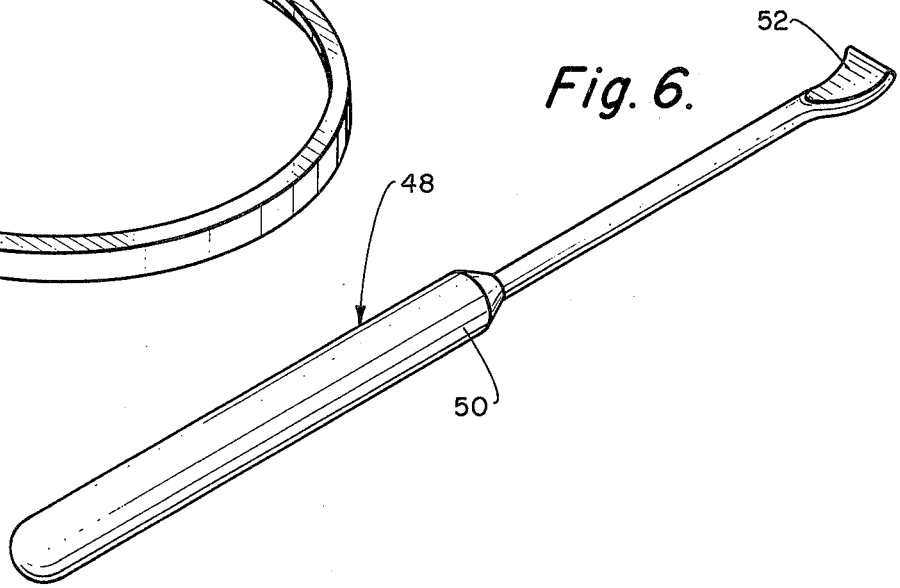
FIG. 6 is an isometric view of a tool to be employed in conjunction with the attachment of this invention to facilitate removal of the lid located within the lid anchoring rim of both the device and the liquid container.

When it is desired to effect stirring of the liquid located within the container 10, the lid 36 is removed and the contents within the container 10 may be vigorously stirred with no fear of any spillage because the length of the attachment 20 is several inches above the top of the container 10. After the contents of the container 10 are thoroughly mixed and a homogenous solution is achieved, the container 10 and the attachment 20 may be employed during the painting operation with the edge of the paint brush being wiped against the anchoring rim 34. In order to prevent any liquid from flowing within the confines of the anchoring rim 34, a plastic rim 38, which is shown in FIGS. 4 and 5, is to be inserted upon the anchoring rim 34. The paint brush will then be wiped against the surface of the plastic rim 38 thereby preventing the liquid from flowing within the confines of the anchoring rim 34.

When it is desired to effect pouring of the liquid from the can 10, a spout 40 is provided located in an upwardly 45° angle with respect to the longitudinal axis of the attachment 20. The spout 40 is integrally formed within the side wall of the housing 22. The outer end of the spout 40 includes an enlarged threaded section which is to be threadably connected to an enlarged cap 42. Within the enlarged cap 42 is formed a smaller sized opening 44 which is closed by a small sized cap 46. If only a small amount of liquid is desired to be removed from the container 10, only the cap 46 may be removed and the contents poured through the spout 40 and outward through the opening 44. If a greater quantity of liquid is desired to be removed from the container 10, the large size cap 42 may be removed from the spout 40. This pouring through the spout 40 can be accomplished either with the lid 36 attached to the anchoring rim 34 or removed therefrom.

In order to facilitate the removal of the lid 36 from either the container 10 or the attachment 20, a tool 48 may be employed which includes a handle 50 and an operating end 52.

What is claimed is:

1. In combination with a liquid container having an access opening, an annular channeled lid anchoring rim surrounding said access opening and mounted within said liquid container, said anchoring rim normally cooperating with a lid to close said container, an attachment connectable with said rim upon removal of said lid, said attachment comprising:

an elongated housing having at the inner end an inner opening and at the outer end an outer opening, an attaching ring mounted upon said housing about said inner opening, said attaching ring connectable in a tight fitting manner with said anchoring rim, a second anchoring rim mounted upon said housing about said outer opening, said lid being connectable in a tight fitting manner with said second anchoring rim;

side opening means provided in the side walls of said housing for pouring the liquid from said liquid container;

said side opening means includes a spout extending outwardly from the side wall of said housing;

said side opening means being closeable by closing means;

said closing means comprises an enlarged cap screw threadingly attached to said spout and a smaller sized cap screw threadingly connected to said large sized cap; and an annular inwardly extending flange attached to said housing and located within said housing adjacent said inner opening, said flange being slightly inclined in a downwardly depending manner from the horizontal and being thin in cross-section, said annular inwardly extending flange functioning to cause any liquid within said housing to be drained back into said liquid container.

2. The combination as defined in Claim 1 including:

a separate plastic ring adapted to fit over said second anchoring rim when said lid is not connected to said second anchoring rim, whereby said plastic ring being adapted to prevent any liquid from entering said second anchoring rim during use.

* * * * *